US005456648A

United States Patent [19]

Edinburg et al.

[11] Patent Number: 5,456,648

[45] Date of Patent: Oct. 10, 1995

[54] REWARD GRANTING EXERCISE MACHINE

[76] Inventors: Peter J. Edinburg, 20 Shellburne Dr., Shelburne, Wilmington, Del. 19803; Frank S. Fountain, 2 Park La. Delaire, Wilmington, Del. 19809; William G. Johanson, 16 Bridleshire Rd., Bridleshire Farm, Newark, Del. 19711

[21] Appl. No.: 213,141

[22] Filed: Mar. 14, 1994

[51] Int. Cl.[6] ..... A63B 24/00

[52] U.S. Cl. ..... 482/4; 482/70; 482/137; 482/900; 434/247

[58] Field of Search ..... 482/1–9, 51, 52, 482/54, 57, 66, 71, 72, 137, 91–95, 900–904, 908, 70; 434/247; 348/61; 364/410, 411, 413.04; 73/379.01, 379.06; 273/440, 454, DIG. 28

[56] References Cited

U.S. PATENT DOCUMENTS

| | | | |
|---|---|---|---|
| 4,298,893 | 11/1981 | Holmes | 273/DIG. 28 X |
| 4,489,938 | 12/1984 | Darzinskis | 482/902 X |
| 4,511,137 | 4/1985 | Jones . | |
| 4,542,897 | 9/1985 | Melton et al. | 482/902 X |
| 4,711,447 | 12/1987 | Mansfield | 482/902 X |
| 4,805,901 | 2/1989 | Kulick | 482/902 X |
| 4,884,803 | 12/1989 | Miller . | |
| 4,915,378 | 4/1990 | Abrahamian et al. . | |
| 5,035,418 | 7/1991 | Harabayashi . | |
| 5,062,632 | 11/1991 | Dalebout et al. . | |
| 5,098,089 | 3/1992 | Harrington et al. . | |
| 5,106,081 | 4/1992 | Webb . | |
| 5,142,358 | 8/1992 | Jason | 434/247 X |
| 5,195,935 | 3/1993 | Fencel . | |
| 5,246,411 | 9/1993 | Rackman et al. | 482/902 X |
| 5,342,261 | 8/1994 | Johnston . | |

*Primary Examiner*—Joe H. Cheng
*Attorney, Agent, or Firm*—Edward J. Kaliski

[57] ABSTRACT

Method and apparatus for exercise in which a preselected work input to an exercise machine that is associated with an award-granting switch triggers a reward. The input can be a particular rate of work as measured by rotational speed or linear motion or a summation of the time during which a threshold level of work was exceeded. The reward can be turning on a TV or like electrical apparatus or it can be a change in the exercise machine and regime. An exercise machine incorporating the award-granting switch is disclosed in which the reward is a change in the angle to horizontal at which the exercise is performed. This change can make the exercise harder or easier depending on the exercise protocol desired.

21 Claims, 9 Drawing Sheets

REWARD GRANTING EXERCISE MACHINE

FIELD OF THE INVENTION

This invention pertains to the field of exercise machines and protocols for the use thereof and particularly to apparatus and method in which the user of an exercise machine is rewarded for achieving some preselected condition of performance.

BACKGROUND OF THE INVENTION

During recent years the importance of regular exercise, especially aerobic exercise, has become widely recognized for a variety of reasons including general health, muscle building, weight control and the avoidance or correction of cardiovascular conditions. Many aids to aerobic exercise have been developed. Unfortunately many such exercise machines are purchased by the well intentioned, used briefly, and abandoned. Often this is due to boredom. Repetition of some physical regime can be highly monotonous. Often it is due to the complication of making the adjustments needed in the apparatus to follow a program of exercise which requires a sequence of different levels of effort according to some plan. Addition or subtraction of weight stacks, or adjustment of levers or tensions between sets of exercise can be time consuming. For example there are known exercise machines in which the angle relative to the ground can be changed to make exercise easier or harder. These are cumbersome to adjust and none provide such an adjustment as a reward for effort expended.

It is, therefor, an object of the present invention to provide an exercise machine, and method of using same, which obviates and mitigates the above-mentioned drawbacks.

SUMMARY OF THE INVENTION

The invention is a means for rewarding an exercise machine's user for exercise performance. The effort of the exerciser is measured and if some preselected condition is equaled or exceeded, a reward is forthcoming which provides incentive to the exerciser to continue his or hers performance in the present or to welcome a return to the exercise machine in the future. The means by which effort is measured can be any one of several such as measuring the RPM (revolutions per minute) of a rotating member of an exercise machine or by measuring power generated as off a generator or by the condition of a strain gauge bridge mounted on some part of the machine strained by the user's effort. In the example described herein we use rate of rotation as the initial input, it being linearly related to the effort expended. It must be recognized, of course, that a single revolution or a given RPM on a machine set to a low level of resistance represents that level and, if the machine is set to a higher resistance, a single rotation or the same RPM stands for a higher effort.

An example of a reward, as will be described in detail later, is the switching on of a television set and maintaining it in the on-condition so long as some preselected level of work is achieved or exceeded.

Variants of this type of reward are described. For example, one such reward is turning on the television permanently only after completion of some preselected effort such as exceeding a work threshold value for a preselected time summation. Another is turning on the television whenever some preselected level of work is achieved or exceeded and making that "on" condition permanent after some preselected summation of that "on" condition is reached.

Other rewards are possible without limit. For example, in an exercise club or the like, the reward might be a token issued by a mechanical device. This could be much like a slot machine and the issued token would have value by permitting purchases from nearby vending machines.

Still another example is an exercise machine having reward granting means in which the physical settings of the machine are changed as a reward. This provides the user with the means to carry out a preset program involving a sequence of different levels of effort without varying from a strict program and without stopping and resetting the apparatus manually.

A preferred example of this reward-granting exercise machine in which the reward is a new machine setting is a peddling-type machine in which the angle at which the user operates the machine changes automatically as a reward. Programs in which the angle changes to make the exercise easier and programs in which the angle changes to make exercise more difficult, or a combination of these, are available.

Any preselected change in conditions as a function of the effort expended is to be considered a reward provided by the invention.

DETAILED DESCRIPTION OF THE PREFERRED EMBODIMENTS

Figure 1:
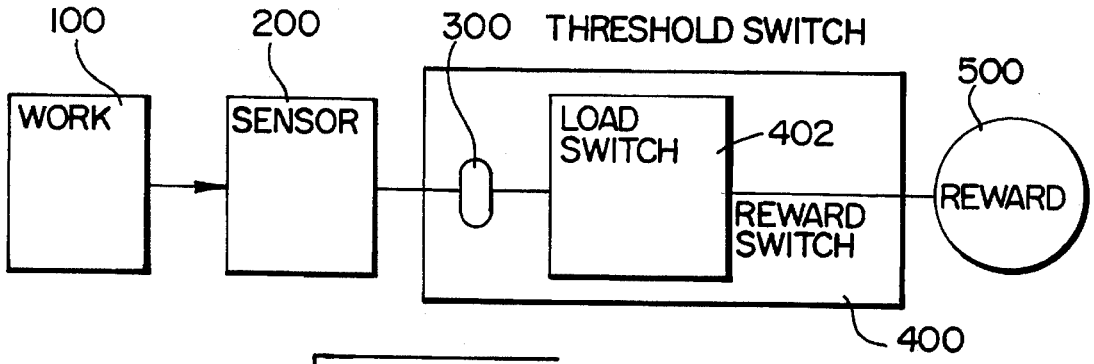
FIG. 1 is a schematic flow diagram for an embodiment of the invention in which a reward is dependent on reaching and maintaining a preselected level of effort.

Refer to FIG. 1. which explains that work done on an exercise machine 100 is measured by a sensor 200. This provides an input to reward switch 400 which comprises threshold switch 300 and load switch 402. Threshold switch 300 is programmed according to a preselected protocol to a measure of effort which, when exceeded, actuates the load switch 402 which provides a reward 500 to the person exercising. The reward may be the actuation of a television set upon reaching or exceeding a selected RPM of a rotating part of the exercise machine or the linear velocity of a reciprocating part. So long as the threshold value is exceeded, the set will remain in the "on" condition. If the exerciser flags in his or her efforts and the RPM falls below the preset threshold value, the set will turn off. Thus, an exerciser has an incentive for maintaining a task. As the resistance of an exercise machine typically can be varied selectively from hard to easy, a given RPM can represent greater or lesser effort on the part of the user. Viewing TV, or listening to music or the like, while doing a workout can reduce boredom. Coupling exercise with a favorite television program can engender regularity of exercise with all the concomitant values. The principle of FIG. 1 can also apply to following a selected exercise regime as will be seen.

Figure 2:
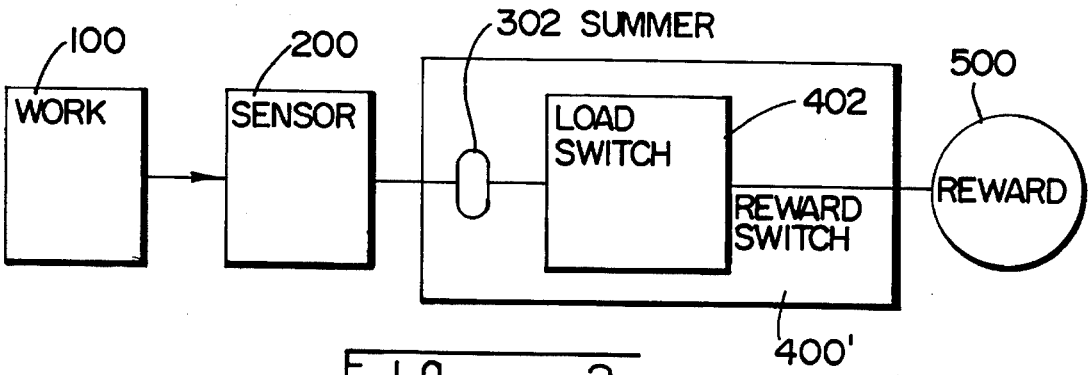
FIG. 2 is a schematic flow diagram for an embodiment of the invention in which a permanent reward is dependent on reaching a preselected summation of effort.
Figure 3:
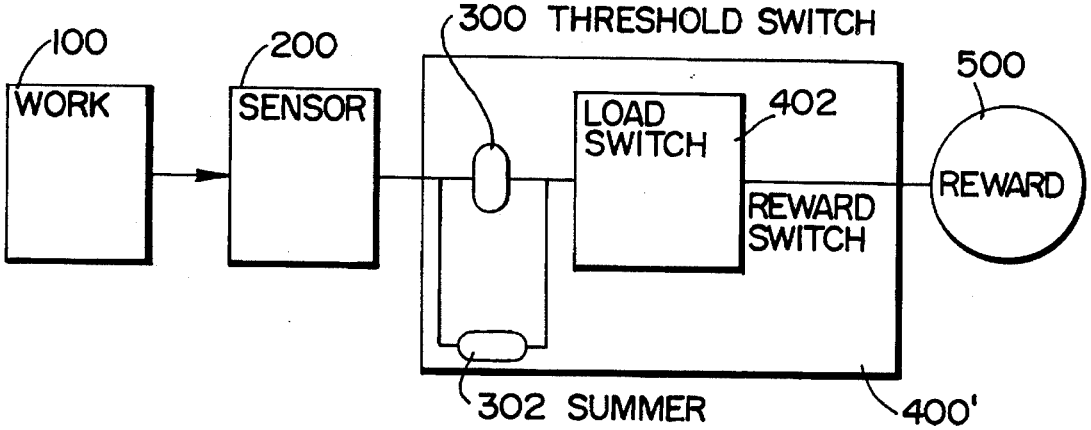
FIG. 3 is a schematic flow diagram for an embodiment of the invention in which a reward is dependent on reaching a preselected level of effort and only upon reaching a preselected summation of that effort does the reward becomes permanent.

FIGS. 2 and 3 show variations on the reward granting theme in reward granting switch 400. In the embodiment of FIG. 2, reward granting switch 400', the output of exercise machine 100 as sensed by sensor 200 is summed by summer 302 where, upon reaching a preselected sum , load switch 402 grants reward 500. In FIG. 3, the scheme of reward granting switch 400" involves a combination of the two embodiments disclosed above. Upon reaching and maintaining a preselected effort monitored by threshold switch 300, reward granting switch 400" activates load switch 402 and grants reward 500 and upon reaching a preselected summation of effort, summer 302 makes reward 500 permanent bypassing threshold switch 300.

Figure 4:
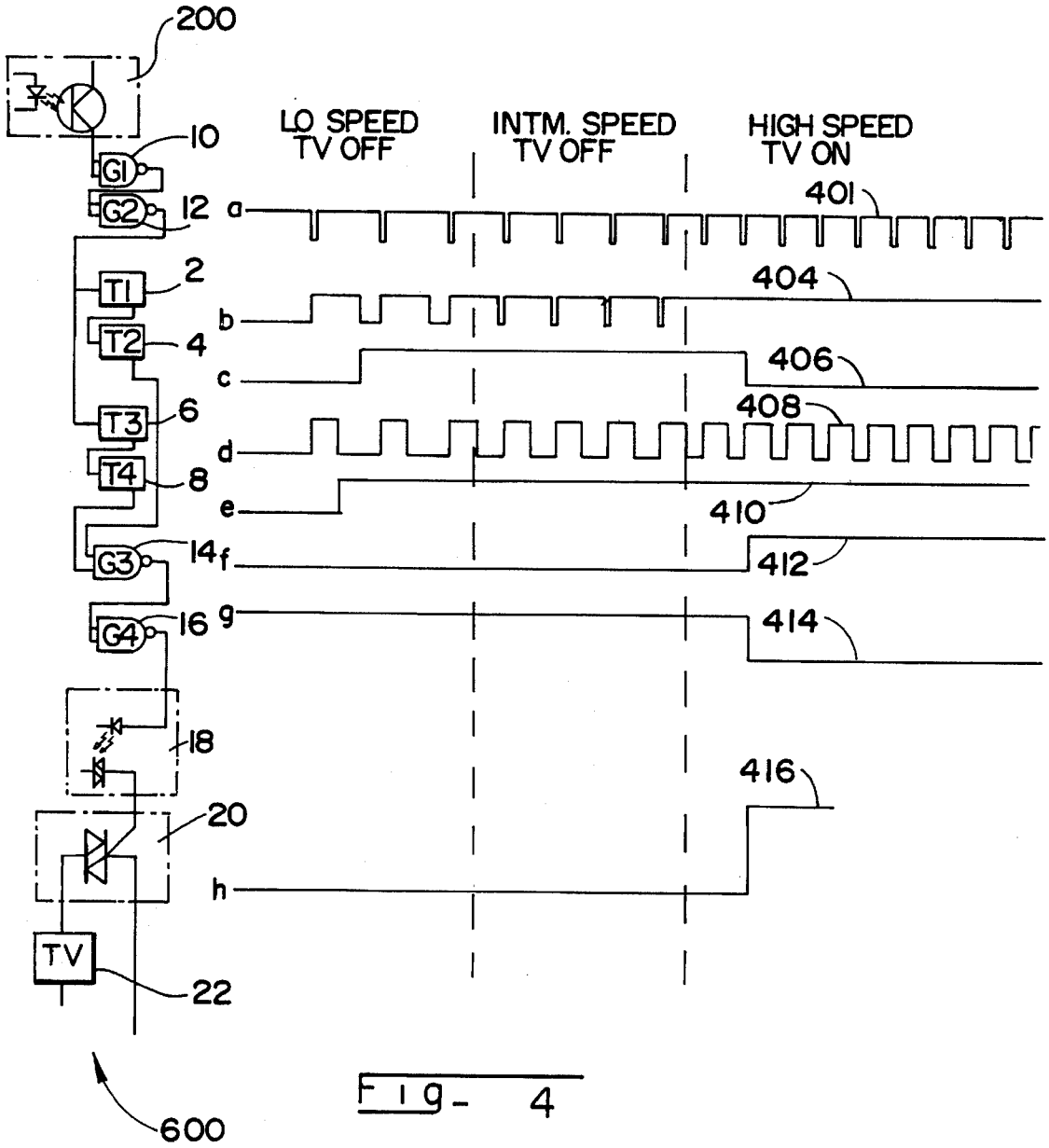
FIG. 4 is a logic diagram wherein traces of the pulsed outputs of selected components are displayed for a speed-actuated, reward-granting switch used in the embodiment of the invention of FIG. 1 wherein the reward is the activation of a TV after a threshold level of effort is reached.

Consider the reward 500 to be actuation of a television set and the exercise machine 100 to be a stationary bicycle. The program set into switch 300 will turn on the TV only if the exercise bicycle is peddled at an RPM greater than one which would propel a true bicycle of a given wheel size at, say, 15 miles per hour. The switch 300 of FIG. 4 is an AC switch that is controlled by the frequency read by an optical sensor 200. Sensor 200 looks at the wheel of exercise bicycle and generates a pulse as a mark on the wheel comes by. We use a white stripe on a black background (not shown). Any mark with a differential contrast to the background could be used as could a variety of other mechanical or electrical devices.

Figure 5:
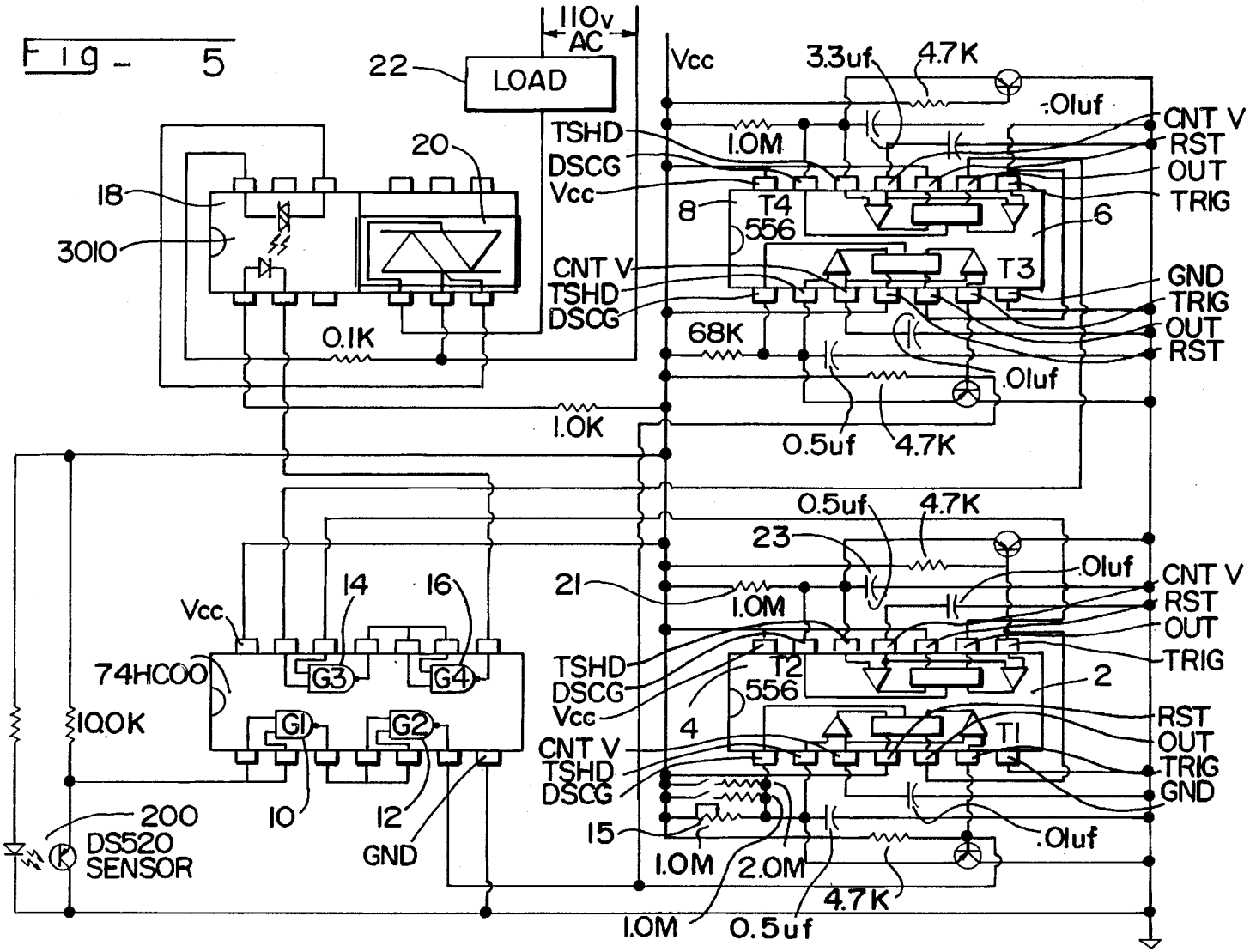
FIG. 5 is circuit diagram of an embodiment of the logic of FIG. 4.

Refer now to FIG. 4, a functional schematic or logic diagram 600 of the invention, and FIG. 5 which is a wiring diagram of the preferred embodiment of this circuit. The electronics 600 for this, best seen in FIG. 4, consists of an optical sensor (we use an optical sensor such as the EE-SY 124 OMRON unit obtained from Digi-Key Corporation of Thief River Falls, Minn.); four timers, designated 2, 4, 6, and 8 (we prefer to use two dual 556 ICs—obtainable from Digi-Key), 74HCOO NAND logic (gates 10 and), also obtainable from Digi-Key, for signal conditioning and combining (one 74HC00 CMOS IC). A NAND is selected over an AND for design convenience. The circuit also has an optical isolator 18 (such as a Isocom 3031 optical isolator from Digi-Key) to switch a triac 20, which switches the AC to the load 22 which in this instance is a TV. The triac we use is an 8 amp unit designated TO-22OAB TECCOR from Digi-Key. The four gates seen in FIG. 4 are in actuality 74HC00s CMOS from Digi-Key. This is a unit sold with four integral gates. The first and second gates 10 and 12 are wired in series to insure a well conditioned signal from the optical sensor and gates 14 and 16 are in series as well as will be seen.

A resistor-capacitor combination sets the timing interval for the timers. In practice, a ten turn pot 15 from Digi-Ken (see FIG. 5) on a printed circuit board (not shown) permits calibration of the unit to the desired speed. Two dip switches, 24 and 26, are used to raise the calibrated turn-on speed to 133%—with first dip switch 24 on, 166%—with the second dip switch 26 on, and 200%—with both dip switches 24 and 26 on. The output of gate 12 as speed increases is seen in trace 401 and this is the input to the first timer 2. For the first timer 2 the timing interval is set to the time for one revolution of the bicycle's wheel at the desired turn-on speed (here 15 MPH). Conditioned pulses (see trace 401, FIG. 4) from the optical sensor 200 turn the first timer 2 on. At slow speeds (below 15 MPH), first timer 2 times out before the next sensor pulse arrives. The output (trace 404) of first timer 2 is then a string of pulses whose width or duty cycle varies with the sensor pulse rate as determined by the speed of the bicycle. When the sensor's pulse interval becomes less than the timing interval of first timer 2, timer 2 is reset before it is timed out. Its output stays high and there are no more pulses. All this is shown in trace 404.

The output of first timer 2 is the input of second timer 4. The output of second timer 4 is seen in trace 406. The timing interval of timer 4 is set shorter than that of timer 2. Timer 2 is, therefor, continually reset before it times out given a suitable pulse rate from first timer 2. Its output stays continually high as long as there are pulses from first timer 2. When these pulses from timer 2 stop, as they would if the speed of the bicycle is higher than the turn-on value, first timer 2 times out and its value goes low. Thus, when the value of timer 2 is high, the speed of the bicycle is less than the turn-on value and the TV should be off and when the value of timer 2 is low, the TV should be "on" (trace 416).

However, if this were the only circuitry, a problem would arise when the bicycle is stopped because first timer 2 would be low which, impermissably, would turn on the TV 22. Third and fourth timers 6 and 8 correct this situation. These two timers, 6 and 8, are connected the same as the first and second timers 2 and 4 except that their time-out times are shorter. The output of fourth timer 8 will always be high with pulses being received from third timer 6 as long as any pulses are generated. This relationship actually does not hold if the speed goes exceptionally high. In the preferred example this would be a pulse rate that reaches an equivalent of about 60 MPH where second timer 4 would go low. That speed, of course, is not realistic. The output of the third timer 6 is shown in trace 408 and that of fourth timer 8 in trace 410.

What we have then is that when first timer 2 goes low second timer 4 remains high, the selected 15 MPH threshold limit having been exceeded, and, because the bicycle is being peddled, the TV should be "on". See trace 416. ANDing the outputs from timer 2 and timer 4 can do this. We prefer to NAND timer 2 and timer 4 together and invert the signal, using gates 14 and 16 (traces 410,412), to properly drive the optical isolator 18 that drives triac switch 20, which is the load switch, to connect the load 22 (TV) to the AC supply.

It should be noted that the wiring diagram of FIG. 5, which is suitable for execution on a printed circuit board, merely is one example of practical embodiments which a skilled designer might use. Other workable component values might well be employed as a designer's choice especially where entirely different reward increments or types are selected.

Figure 6:
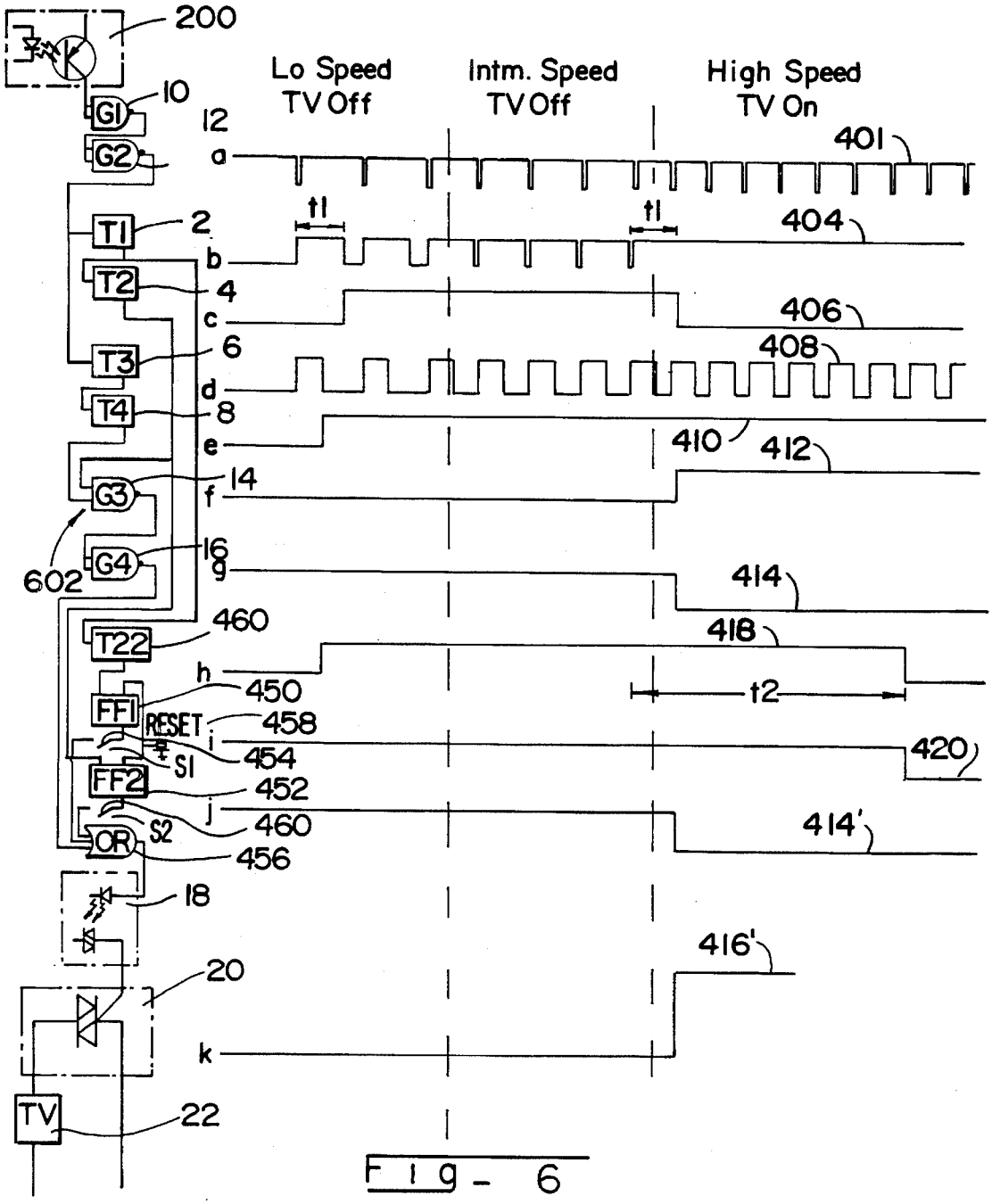
FIG. 6 is a logic diagram for a speed-actuated, reward-granting switch, wherein traces of the pulsed outputs of selected components are displayed, used selectively in embodiments of the invention of FIG. 1, or 2 or 3.

Refer now to FIG. 6. This shows the logic diagram 602 for an embodiment of the invention in which the reward is selectively that of FIG. 1, or 2 or 3. That is to say, if the system of FIG. 1 is selected, the TV 22 is turned on if a selected speed is exceeded and the TV 22 is off if the speed falls below the specified value. If the system of FIG. 2 is selected, the TV 22 is turned on if the selected speed is exceeded for a specified period of time and the TV 22 is not turned off nor need any further exercise be performed. If the system of FIG. 3 is selected, the TV 22 is turned on if speed is exceeded and turned off if speed falls below the specified value but is turned on permanently if speed is maintained for a specified period. This is a combination of the systems of FIGS. 1 and 2.

Granting the reward when the condition (speed) has been maintained for some period of time is the functionality of the logic of FIG. 4 where the period of time was set rather short. We use one-half second. To change this period only requires the changing of resistor 21 and/or the capacitor 23 on second timer 4 of FIG. 5. For example, to set the time period for one minute, a 10 m resistor and a 6 uf capacitor would be substituted for the 1 m resistor and 0.5 uf capacitor shown.

To make the reward permanent requires some sort of logic latch. In FIG. 6 a flip-flop 450 is chosen. To turn on TV 22 if speed is exceeded for a specified period of time and it is not turned off (permanent reward), the resistor-capacitor combination in conjunction with second timer 4 would be selected to give the desired exercise period and the output of second timer 4 would be used to set a flip-flop 452 to the "on" condition. The switch 454 below flip-flop 450 would be closed when this mode was desired. The flip-flop on-condition through an OR gate 456 would hold, continuously, the triac gate 18, triac 20 and TV 22 "on". A manual reset 458 would be used to return the system to the "off" condition.

To use the system in the mode where load 22 (TV) is turned on if set speed is exceeded and turned off if the speed falls below that value but when the total time speed is exceeded reaches a specified period the TV 22 is turned on permanently, an additional timer is needed. This is the timer 460. Here timer 4, and timer 460 are identical except that the resistor-capacitor combination would be selected for timer 4 for a short time interval and the interval for timer 460 for a longer period. As in the preceding case, in order to make the action of timer 460 permanent, its output 418 drives a flip-flop 452 whose output through OR gate 456 holds the triac gate 18 and switch 20 and TV 22 permanently on. To operate in this mode, the switch 460 below flip -flop 452 would be closed. As the exerciser speed exceeded the set speed, TV 22 would turn on; if the speed fell below set speed, TV 22 would be off. Once the reward period was reached, TV 22 would go on and stay on until manual reset 458 was pushed.

It will be apparent that other combinations may well be provided as will occur to those in the art and these too are to be considered within the scope of this invention.

Figure 7:
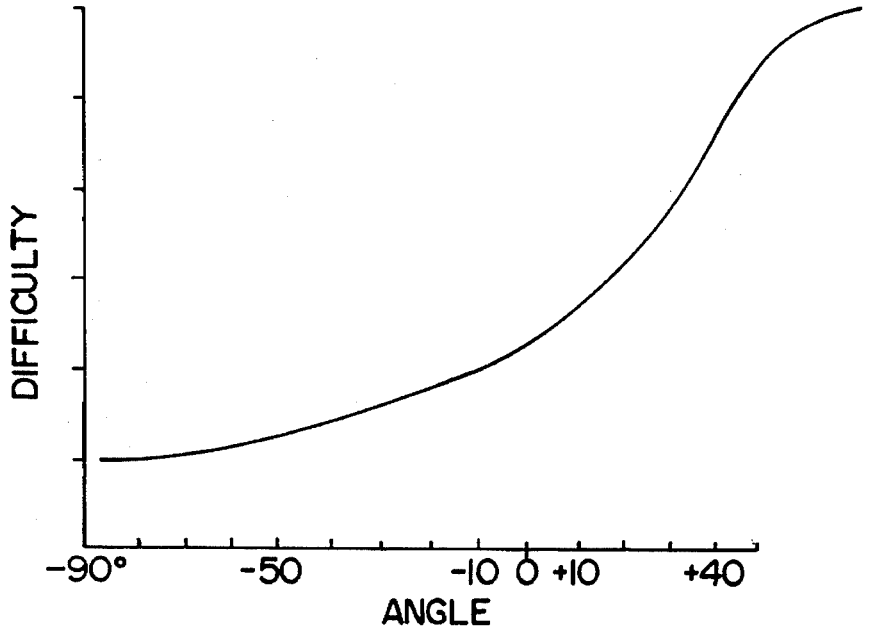
FIG. 7 is a graph of the inventors' subjective evaluation of the difficulty of the effort expended in a limb-extension exercise machine as a function of the angle relative to the ground at which the user of the machine exercises.

For example, a preferred embodiment provides as a reward a change in the difficulty of exercising. Refer now to FIG. 7. This is a subjective evaluation by the inventors of the difficulty of effort involved in operating a stationary bicycle with the direction in which the user peddles aligned at various angles to the ground designated according to the convention shown in FIG. 8. In normal cycle operation the trunk of the cyclist is upright and the direction of peddling is essentially vertical. This is designated for the purpose of the figure as negative 90 degrees. When the legs of the cyclist are in the horizontal position the angle is named as zero degrees. A cyclist in the zero position is not flat on his or her back but while exercising is extending his or her legs horizontally and the direction of motion of the feet is substantially horizontal. Indeed, in our preferred apparatus as will be seen, peddling is not the usual rotary motion but is truly linear, an exercise condition recognized by many as superior to rotary peddling. When the user exercises with the feet at levels above zero, the angle is designated positive. The difficulty increases as the feet rise above zero as shown in FIG. 7.

Figure 8:
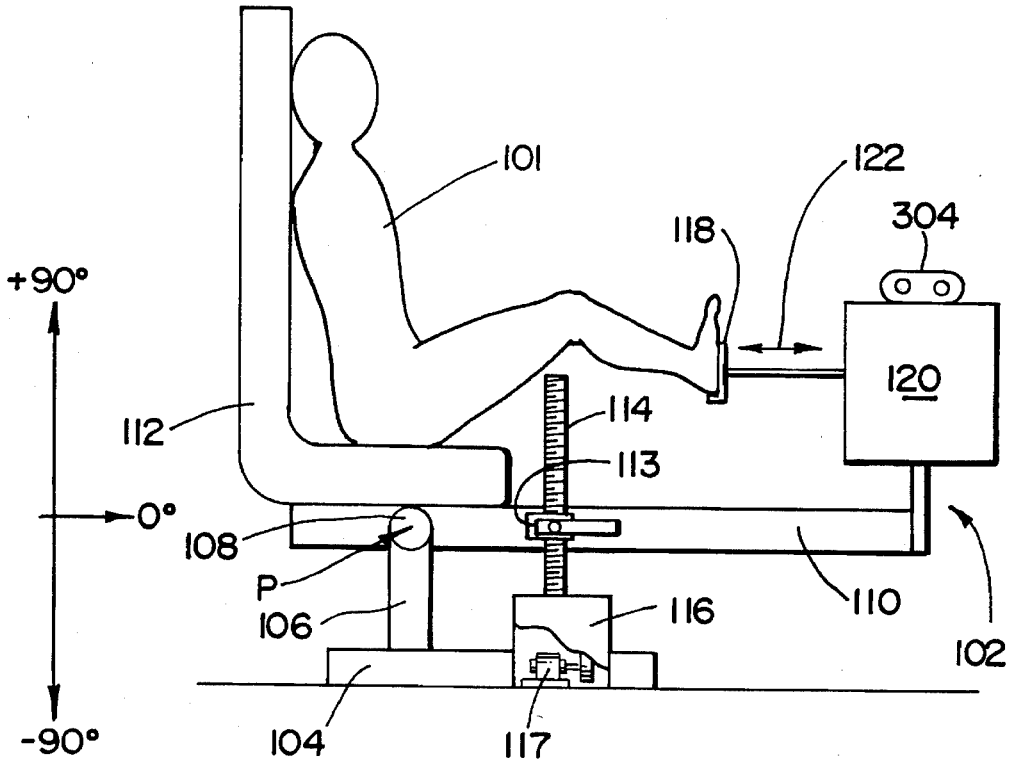
FIG. 8 is a side elevational view of a user exercising on a leg-extension exercise machine in which the exercise attitude is variable by means of a mechanism controlled by the reward-granting switch of the invention and wherein the leg-extension of the user is linear.

In FIG. 8 a person 101 is seen working out on the apparatus of the invention 102. The basic nature of this piece of exercise equipment is that of a recumbent aerobic exerciser which has the capability of adjusting its attitude, the angle to the floor at which the person exercising will be. The angle can be set before starting to exercise in equipment of this type which is known but the machine of the invention changes the angle as a function of the effort expended while exercising. For this reason we also call the exercise machine "the recliner".

Base 104 supports a pedestal 106 which is pivotally attached at pivot 108 to frame 110 which supports seat 112 for the exercising person 101. Frame 110 carries a pivotally mounted internally-threaded fitting 113 through which runs a threaded shaft 114. This screw shaft is driven in reversible rotation by an electric motor 117, shown through the cut away portion of cover 116 in which it and suitable gearing not shown are mounted, the motor 117, bearings and the like being supported by frame 104. It should be noted that this particular screw and nut mechanism described here is just one of many mechanical arrangements that can be deployed to controllably inter-relate the angle between base 104 and frame 110. A scissor jack could be used as could various pneumatic and hydraulic devices; all being within the scope of the invention.

Figure 9:
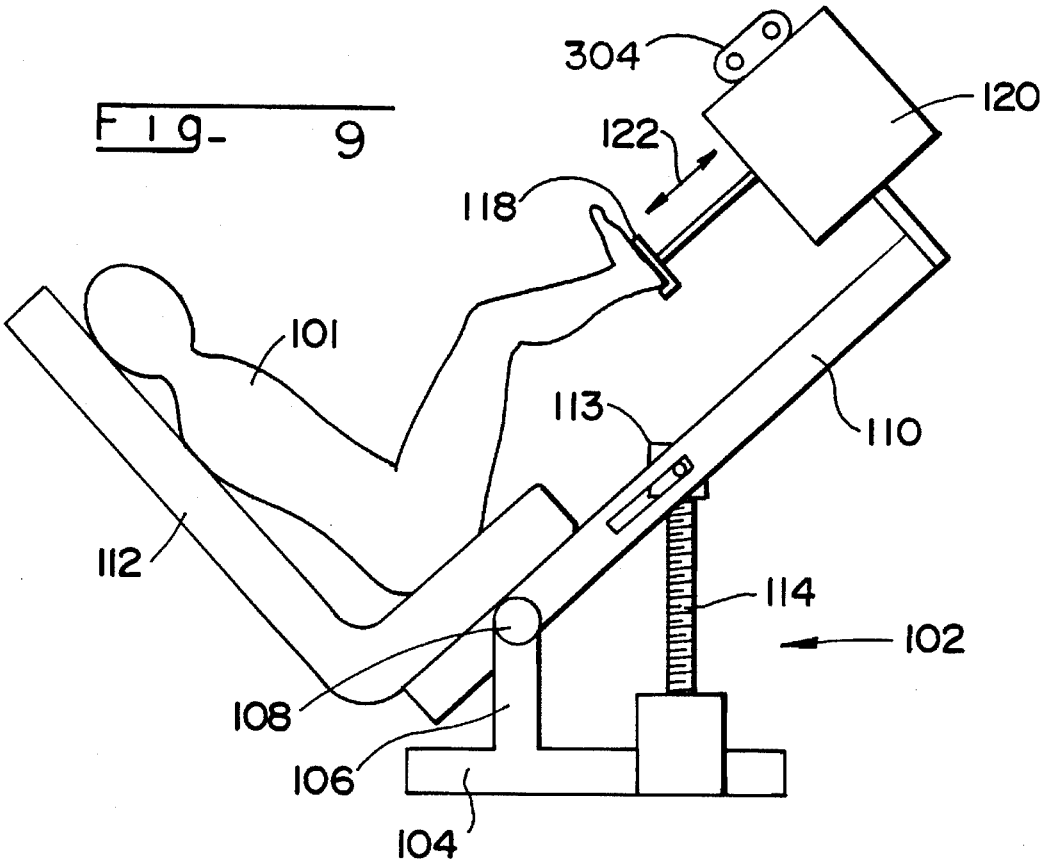
FIG. 9 is a side elevational view of the machine of FIG. 8 in which the angle has been changed so that exercise proceeds at about 45 degrees above horizontal.
Figure 10:
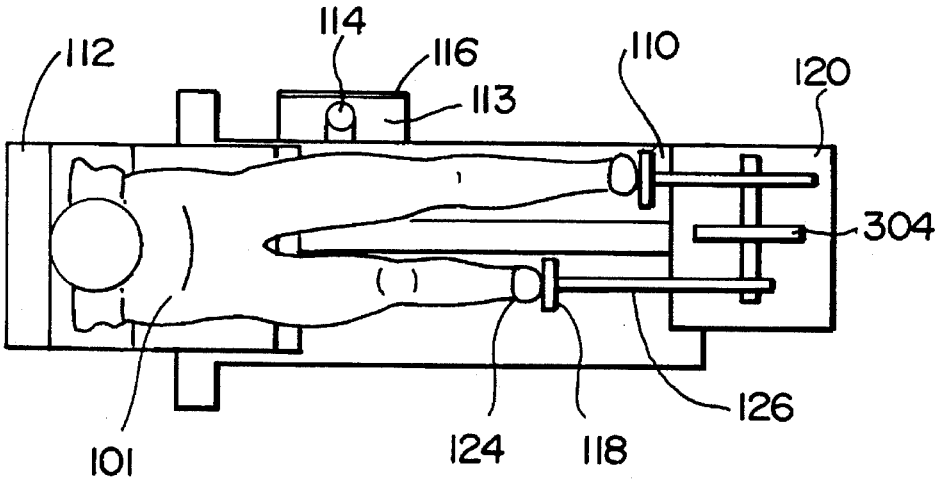
FIG. 10 is a top view of the arrangement of FIG. 8.

The person exercising does so by extension of the legs and we prefer that the action be linear. The principle, of course, is readily applied to the arms as well and the apparatus can be adapted for this purpose. Handles would have to replace or be added to peddles 118 and tension module 120 raised to chest height. In either case, limb extension and retraction can be done both limbs together, an action not possible on a cycle, or alternately. We prefer the pumping action (linear motion) 122 as opposed to cycling action to minimize the amount of shake and because we believe it to be a more effective form of exercise. FIG. 9 shows the apparatus inclined at about 45 degrees and FIG. 10 is a plan view of the apparatus shown in FIG. 8.

Figure 13:
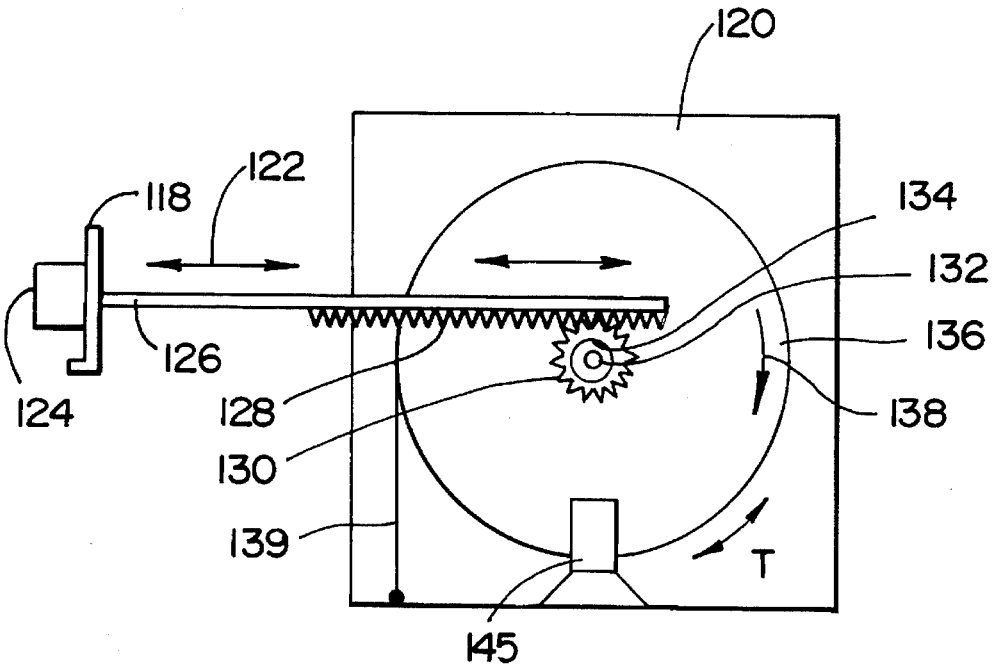
FIG. 13 is a side elevational view of apparatus for linear-limb-extension input into an exercise machine of the invention using a n electromagnetic resistance means.

Tension module 120 contains the means to perform this linear action as well as the means to provide adjustable resistance to motion to set the level of effort. Refer to FIG. 13. The person 101 puts a foot onto each of two pedals 118 where straps 124 serve to keep the feet in place. Pedals 118 are fixed to bars 126 which carry rack 128 on one side inside of module 120 and are constrained to move linearly. In turn rack 128 is meshed with pinion gear 130 which drives shaft 132 through one-way clutch 134. Shaft 132 turns flywheel 136 which is ferromagnetic, or has a ferromagnetic region along its periphery, and turns through selectively variable electromagnet 145. When either foot is extended, the resultant direction of rotation is always in the direction of arrow 138. A variable torque T is applied to flywheel 136 by varying the magnetic force applied to the flywheel 136 which is done by varying the power supplied to electromagnet 145.

Figure 15:
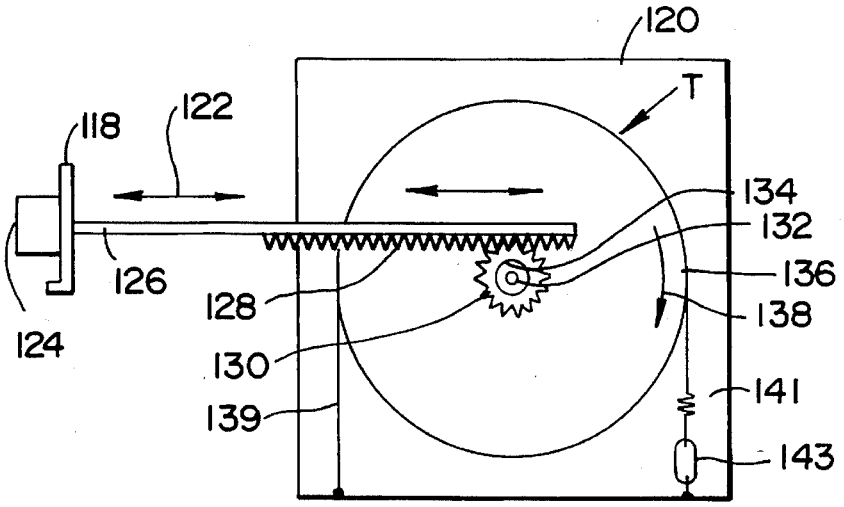
FIG. 15 is a side elevational view of apparatus for linear-limb-extension input into an exercise machine of the invention using a friction brake resistance means.

The applied torque may be varied in other of the known ways, electrical, mechanical, hydraulic or pneumatic. One such is seen in FIG. 15. A tape 139 passing around the flywheel 136 is anchored at one end to the module 120 and at the other end is fastened via a spring 141 to a turnbuckle 143 or the like also fastened to the module 120 (in practice a calibrated scale is provided to facilitate setting the load but this is not shown here).

Figure 12:
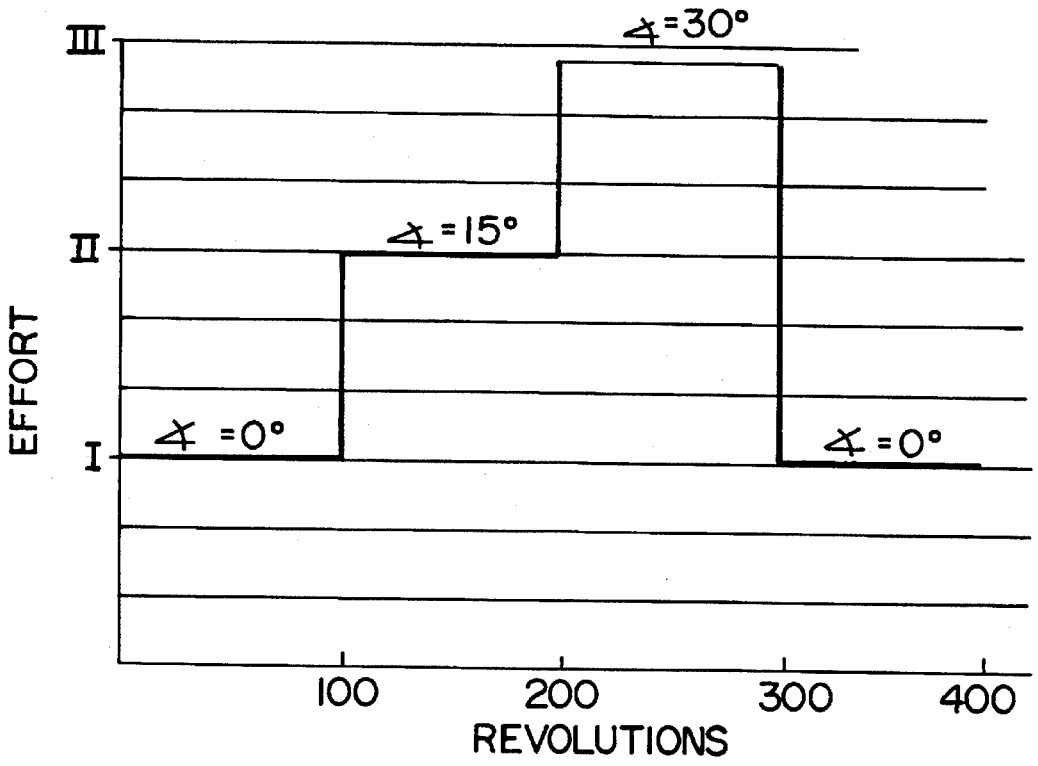
FIG. 12 is a graph of an exercise program in which "interval training" is enabled by changing the working angle as a reward.

In use of the reward granting exercise machine 102 of the invention, the person 101 selects the desired resistance and selects the desired program in circuit 600 by operating the appropriate dip switches. Then the desired exercise regime is set on programmer 304 (see FIG. 8). This may be a programmable controller as is familiar to electrical designers skilled in ladder logic. Preferably, the programmer 304 is an embedded microcomputer; a chip of suitable design familiar to those skilled in digital design. This controller 304 replaces the TV 22 as the load in the circuitry of FIG. 4 and would output to a relay or the like. The computer clock would be used as a counter where required and the system would best be menu driven. The exerciser sits on seat 112, somewhat in the position of a person riding a recumbent bicycle as shown in FIG. 8 and designated as at zero degrees. Both feet are placed on the peddles 118 using straps 124 and the exercise routine begins. Let us say that the control circuit 600 has been set to a threshold of 15 miles per hour and that threshold level is reached starting controller 304 to follow the zero angle portion of FIG. 12. When a preset 100 revolutions of flywheel 136 has been reached, controller 304 energizes the reversible electric motor 117 and drives it a selected number of turns to elevate the frame 110 to a 15 degree angle and so on to a 30 or 45 degree angle (approximately as shown in FIG. 9) and then back to zero each time doing so only if the preset number of revolutions is accomplished when the threshold RPM is held or exceeded. This is an exercise program known as "interval training" referring to a workout in which there are periods of high output in the midst of periods of base load effort. An interval training program is shown in FIG. 12. It is arbitrary and just as well could have been a sequence of easy and hard intervals such as 100 revolutions at zero followed by 100 revolutions at 15 degrees. Of course an interval regime could be easy—hard—easy—hardest (where hardest is 30 degrees) or any combination of conditions all attained by suitable reprogramming of controller 304.

Figure 11:
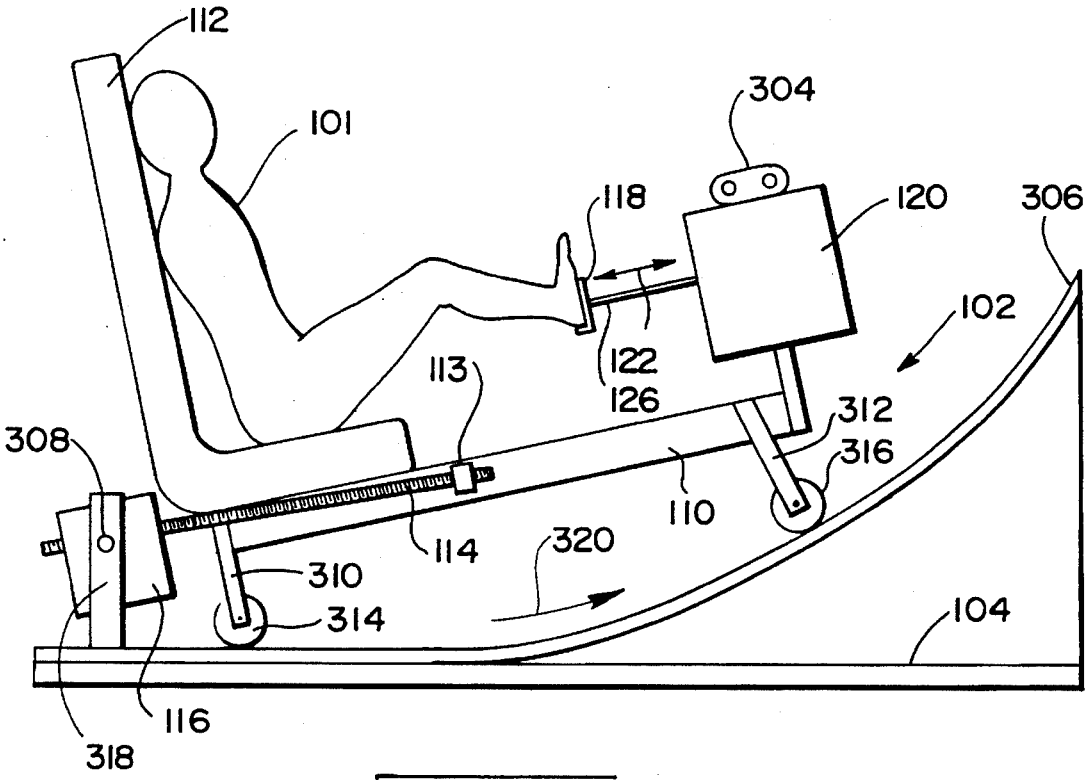
FIG. 11 is an embodiment of an exercise machine in which the angle-changing means is a curved track.

Consider FIG. 11 which shows an alternate embodiment of the angle changing means of the invention. This is one in which exercise machine 102 has frame 110 supported by two pair of legs 310, 312 each leg having wheels 310, 312. The wheels run on curved track 306 which is fastened to base 104. Covered mount 116 is supported at pivot 308 by structure 318, also fastened to base 104. Internal to mount 116 is an internally-threaded nut, not shown. This permits screw 114 which is pivotally fastened to frame 110 at collar 113 to be extended and retracted by the reversible electric motor 117 to drive exercise machine 102 up and down track 306 as shown by double-ended arrow 320. The angle of mount 116 changes as required. Thus the attitude at which exercise is done is changed by whatever reward program is selected. Screw 114 is best arrayed to act upon frame 110 at the longitudinal centerline.

Figure 14:
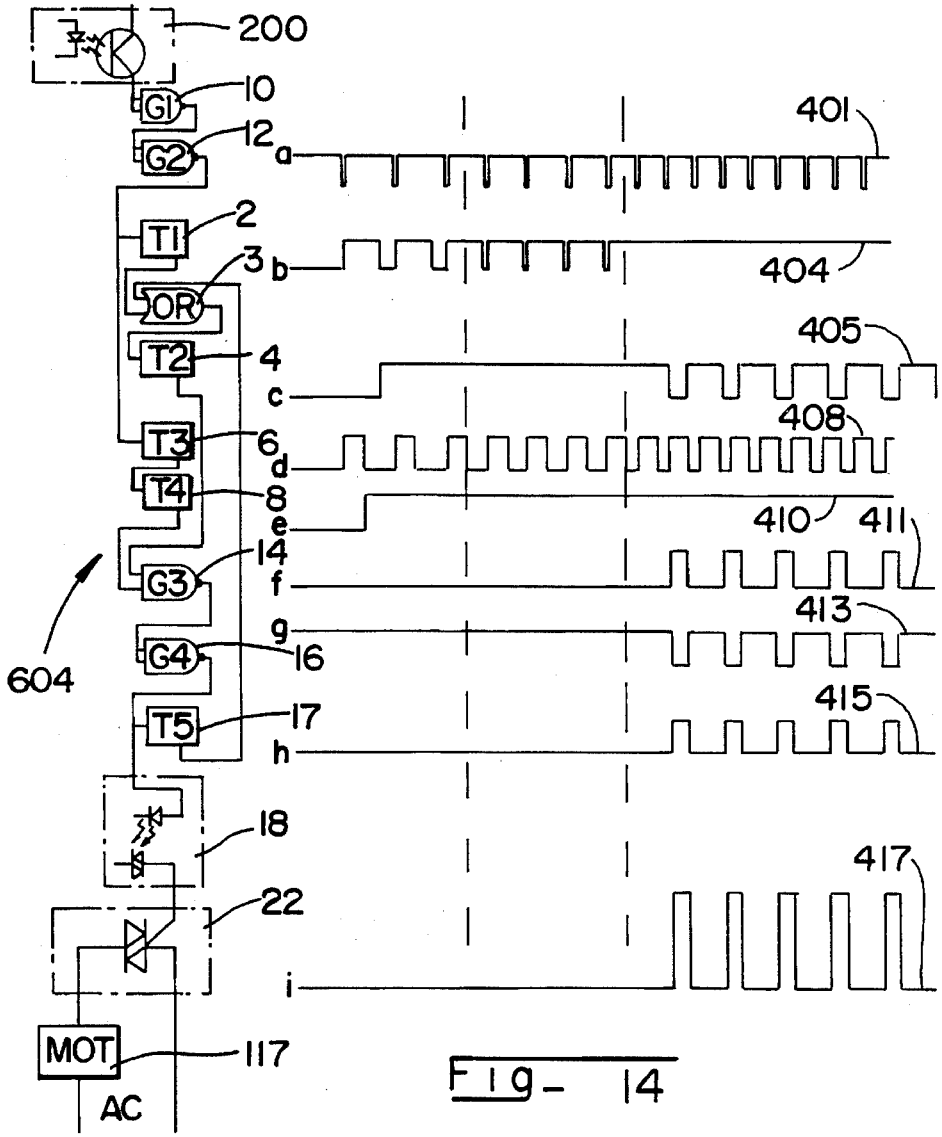
FIG. 14 is a logic diagram for a speed-actuated, reward-granting switch, wherein traces of the pulsed outputs of selected components are displayed, used in an embodiment of the invention of FIG. 1 wherein the reward is the activation of the angle adjusting means of an exercise machine after a threshold level of effort is reached.

Consider FIG. 14. The logic 604 shown therein drives motor 117 within enclosure 116 to activate the angle adjusting means in a selected direction of rotation. This logic 604 is derived from the previous logic 600 (FIG. 4) for the reward- granting switch in which exercise on a stationary bicycle yielded turning on of a TV 22.

With this logic used with the incliner bicycle of FIG. 8 or 9, the logic output from fourth gate 16 is used to trigger an additional (fifth) timer 17. The output of this fifth timer 17 drives the triac group 22 (protected by optical isolator 18) to turn on the AC power to the motor 117 driving the elevation screw 114 of the incliner 102. The time interval of this fifth timer 17 is set so that the motor 117 runs for the period necessary to achieve the desired angle of rotation (we use 15 degrees). Limit switches which are not part of the logic and are not shown would close when the incliner 102 reaches the maximum angle to reverse the motor 117 and drive it to the zero position.

Operation is as follows: if the machine is operated below the set speed, nothing happens and the machine stays at the zero or home position; if the operator exceeds the set speed for the required period, power is applied to the incliner motor 117 for the required period of time to drive the incliner 102 to its incremental angle (fifteen degrees,for example); the logic is reset via the fifth timer 17 triggering second timer 4; here the same logic applies and if the speed falls below the set speed, the incliner 102 remains as is (or could reverse to put the incliner back to zero degrees), but if the speed exceeds the set speed for the specified period, the triac 22 again applies power to the incliner motor 117 to drive through another increment. The increments are fixed for a given setting. Angle increments are adjusted by changing the timing of fifth timer 17.

In essence then, the embodiment of FIG. 14 performs a sequence of functions according to FIG. 1 with each reward at a higher level of effort. With an embedded microcomputer as taught previously, a selection of interval programs can be provided in which differing levels of difficulty of effort (hardness) can be sequenced. For example, the exerciser could be programmed to change the angle of work in proportion to the effort expended by sequencing a series of threshold speeds in increasing order thus requiring the person using the equipment to work harder and harder ultimately driving the exerciser to its maximum inclination where the apparatus would reset to a zero angle which might be termed the reward of rewards. Other programs will occur to those adept in exercise routines and are to be considered within the scope of this disclosure.

We claim:

1. An exercise machine comprising means upon which a user performs work; means to measure said work; and means responsive to a preselected condition of said measured work to initiate a rewarding action and said preselected condition is selected from the group consisting of a level of said measured work; and, there being summing means, a preselected sum of the time at which said level is exceeded; and wherein the means upon which work is performed comprises means for selective-level resistance to limb extension and retraction by a user performing work upon said exercise machine; said exercise machine providing a support for said user and said user, so supported, exercises at a selected angle to horizontal; and said reward is a change in said selected angle.

2. The exercise machine of claim 1 wherein:

the means for measuring said work is an optical sensor responsive to a mark rotating on a part of said exercise machine as driven by the user to generate a stream of electrical sensor pulses synchronous with the RPM of said rotating part; and the means responsive to said measured work comprises a circuit comprising:

a first timer with a timing interval set to the time for one said RPM at the preselected reward condition, said first timer receptive of said stream of sensor pulses to generate a first stream of timer pulses with each pulse of said first stream of timer pulses timed out before the next pulse arrives at RPMs below said reward condition, and each pulse of said first stream of timer pulses remaining on above said reward condition;

said first stream of timer pulses input to a second timer having a timing interval shorter than said first timer whereby said second timer responsive to said first stream of timer pulses remains on below said reward condition and goes low above said reward condition;

said circuit further comprising a third timer in parallel to said first timer and having a shorter timing interval than said first timer and, responsive to said stream of sensor pulses, generating a third stream of timer pulses fed to a fourth timer;

said fourth timer having a timing interval shorter than said third timing interval and said fourth timer being in the on condition so long as a stream of sensor pulses is generated; and the outputs of said second and fourth timer being NANDED and inverted whereby said rewarding action is initiated by switching means so long as said rewarding condition is exceeded and said stream of sensor pulses is generated.

3. The exercise machine of claim 2 wherein said apparatus comprises:

a base upon which a pivot is elevated;

wherein said user-support comprises a frame rotationally mounted on said pivot for rotation within an angular range relative to horizontal;

angle adjusting means connecting said base and said frame for regulating the angular relationship between said base and said frame;

wherein said selective-level resistance means is mounted on said frame for actuation by said user to produce work;

said work measuring means is in measuring association with said selective-level resistance means; and computational means responsive to input from said work measuring means according to a selected protocol related to said measured work; and, and upon reaching a preselected condition, to actuate said angle adjusting means to adjust said angular relationship as a reward according to a preselected program resident in said computational means.

4. The exercise machine of claim 3 wherein said limb extension and retraction is linear.

5. The exercise machine of claim 3 wherein said limb is at least one of said user's arms.

6. The exercise machine of claim 3 wherein said limb is at least one of said user's legs.

7. The exercise machine of claim 3 wherein said limb is both of said user's arms.

8. The exercise machine of claim 3 wherein said limb is both of said user's legs.

9. The exercise machine of claim 7 wherein said user's arms are extended simultaneously.

10. The exercise machine of claim 7 wherein said user's arms are extended alternately.

11. The exercise machine of claim 8 wherein said user's legs are extended alternately.

12. The exercise machine of claim 8 wherein said user's legs are extended simultaneously.

13. The exercise machine of claim 3 wherein said selective-level resistance means is a fly wheel and associated braking means.

14. The exercise machine of claim 3 wherein said work measuring means is selected from the group consisting of revolution counters and torque sensors.

15. The exercise machine of claim 3 wherein said angular range relative horizontal is minus 90 degrees to plus 45 degrees.

16. The exercise machine of claim 3 wherein said computational means is selected from the group consisting of personal computers and programmable controllers.

17. The exercise machine of claim 3 wherein said angle adjusting means is a screw and nut mechanism said screw rotated by a reversible electric motor.

18. The exercise machine of claim 3 wherein upon accumulation of a preset sum of work said program initiates adjustment of said angle from a preset initial angle to a second preset angle, said second angle being closer to horizontal than said initial angle.

19. The exercise machine of claim 3 wherein upon accumulation of a preset sum of work said program initiates adjustment of said angle from a preset initial angle to a second preset angle, said second angle being farther from horizontal than said initial angle.

20. The exercise machine of claim 3 wherein upon accumulation of a preset sum of work said program alternates initiation of adjustment of said angle between two programs in which said angle is adjusted from an initial preset angle to a second preset angle, said first program wherein said second angle is closer to horizontal than said initial angle and said second program wherein said second angle is farther from horizontal than said initial angle.

21. The exercise machine of claim 2 wherein said exercise machine comprises:

a base;

angle adjusting means pivotally mounted upon said base comprising a screw and nut mechanism said screw rotated by a reversible electric motor.

a user-supporting frame mounted on wheels running on a curved track associated with said base such that position along said track provides rotation of said frame within an angular range relative to horizontal;

selective-level resistance means mounted on said frame for actuation by limb extension and retraction by said user to produce work:

work measuring means in measuring association with said selective-level resistance means; and computational means responsive to input from said working measuring means according to a selected protocol related to said measured work; and, and upon reaching a preselected condition, to actuate said angle adjusting means to adjust said angular relationship as a reward according to a preselected program resident in said computational means.

* * * * *